US006320572B1

(12) United States Patent
Takabayashi et al.

(10) Patent No.: US 6,320,572 B1
(45) Date of Patent: Nov. 20, 2001

(54) CONTROL CIRCUIT FOR LIQUID CRYSTAL DISPLAY

(75) Inventors: Tsutomu Takabayashi; Masaru Nishimura; Hirofumi Shinohara, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/168,565

(22) Filed: Oct. 9, 1998

(30) Foreign Application Priority Data

Jan. 4, 1998 (JP) ..... 10-088525

(51) Int. Cl.[7] ..... G09G 5/06
(52) U.S. Cl. ..... 345/204; 345/211; 345/213
(58) Field of Search ..... 345/204, 211, 345/213, 212

(56) References Cited

U.S. PATENT DOCUMENTS 4,563,676 * 1/1986 Leininger ..... 345/213
4,623,925 * 11/1986 Tults ..... 358/183
4,821,297 * 4/1989 Bergmann et al. ..... 375/120
5,072,315 * 12/1991 Tsunashima ..... 360/36.2
5,949,397 * 9/1999 Koyama et al. ..... 345/213
6,011,533 * 1/2000 Aoki ..... 345/213
6,040,828 * 3/2000 Park ..... 345/213

FOREIGN PATENT DOCUMENTS

15234/1998 5/1998 (KR) .

* cited by examiner

*Primary Examiner*—Richard Hjerpe
*Assistant Examiner*—Kimnhung Nguyen
(74) *Attorney, Agent, or Firm*—Oblon, Spivak, McClelland, Maier & Neustadt, P.C.

(57) ABSTRACT

A control circuit for controlling a driving circuit that provides signals to a displaying means, wherein a function of outputting a plurality of digital signals at different phases is included, and said phases can be set by selective elements.

15 Claims, 13 Drawing Sheets

CONTROL CIRCUIT FOR LIQUID CRYSTAL DISPLAY

BACKGROUND OF THE INVENTION

1. Field of the Invention

The present invention relates to a control circuit for controlling a driving circuit which provides signals to a displaying means such as a liquid crystal display for processing numerous digital data at high-speed. More particularly, the present invention relates to a control circuit in which there have been considered to cope with noise and undesired electromagnetic radiation in the control circuit.

2. Discussion of the Background

A conventional control circuit for controlling a driving circuit which provides signals to a displaying means such as a liquid crystal display for processing digital data at high speed generates undesired electromagnetic radiation when a digital signal is switched whereby other appliances are badly affected. Conventionally, there have been considered such as reinforcing of GND (i.e., lowering of grounding resistance), balancing of the circuit, providing the controlling circuit with a filter or shielding the controlling circuit with a metallic enclosure. Balancing of the circuit as mentioned herein indicates that wiring are designed so as not to cross with each other or the GND which functions as a returning path is reinforced in underlying layers of high-speed cables.

Accompanying progresses in digital electronics technology, high-speed processing of data is improving, and the switching speed of digital signals is accordingly increasing, whereby electric changes are transformed into electromagnetic energy so as to be radiated at the time of switching as electromagnetic waves and badly affect peripheral electric appliances. While consideration has been conventionally taken in view of the controlling circuit itself such as reinforcing GND, providing the controlling circuit with a filter or designing of wiring, consideration related to a timing controller of the liquid crystal display which serves as a generating source is still not sufficient.

As a consideration for coping with noise and undesired radiation of digital signals in a propagation path, a capacitor or a filter which is comprised of inductors may be provided on a wiring board. However, it may happen that the delay of signals owing to the filter becomes large at certain filter constants, and no set up time and hold time can be secured. Thus, a drawback is presented in that there are restrictions in the selection of filters.

Techniques for decreasing such undesired electromagnetic radiation are disclosed in Japanese Unexamined Patent Publication No. 232317/1991, Japanese Unexamined Patent Publication No. 219016/1992, Japanese Unexamined Patent Publication No. 186480/1996 and Japanese Unexamined Patent Publication No. 171531/1985.

In Japanese Unexamined Patent Publication No. 232317/1991 there is disclosed a technique in which a delay circuit for shifting phases of signals input to each output buffer is provided for the sake of decreasing the number of output buffer that simultaneously activate. However, it is in danger that the number of gates may increase accompanying the provision of a delay in each signal. In Japanese Unexamined Patent Publication No. 219016/1992, there is disclosed a technique in which varying timings of output data are respectively shifted by applying phase differences to clock pulses which are respectively input to a plurality of flip-flops. However, the interval for shifting the output timings can not be selected, and it may be that the noise level may increase up to a prescrived signal frequencies at which they synchronize or interfere with the phase shifting amount, while setting of one phase difference can not result in low noises and low EMIs when the frequency has been changed. Further, in Japanese Unexamined Patent Publication No. 186480/1996, there is disclosed a technique in which a multi-layered clock generating circuit is provided and each output buffer is activated by several types of clock signals which are of same frequency and which phases are uniformly shifted. However, when employing a multi-layered clock generating circuit, electromagnetic waves may be radiated by the multi-layered clock generating circuit itself, and the number of gates comprising the multi-layered clock generating circuit itself increases. In Japanese Unexamined Patent Publication No. 171531/1985, there is disclosed a technique in which there is provided at the side of the driving circuit a means for shifting phases of each video signal. However, in case the intervals of outputted timings for shifting phase are kept constant and the signal is a signal such as a picture image signal which keeps on changing, it may happen that generated noise synchronizes and increases at certain frequencies due to the shifting of the data signals and phase differences as discussed above.

It is an object of the present invention to solve such problems and to provide a control circuit for decreasing radiation of electromagnetic waves and, decreasing noise accompanying the high-speed processing of data.

SUMMARY OF THE INVENTION

The control circuit of the present invention is a control circuit for controlling a driving circuit that provides signals to a displaying means and which is provided with a function of outputting a plurality of digital signals at different phases, wherein the phases can be set by selective elements.

The control circuit of the present invention outputs a plurality of digital signals at different phases, wherein phase differences are provided at different intervals and at several stages.

The control circuit of the present invention is provided with a function of outputting a plurality of digital signals at different phases, wherein phase differences can be changed with time.

The control circuit of the present invention is provided with a function of assigning phase differences to the digital signals by providing phase differences of several stages to clock signals in the control circuit and processing data signals by delayed clocks.

According to the present invention, in order to cope with noise and extraneous electromagnetic radiation, phases of digital signals are changed during a data processing process in the IC for assigning phase differences to current flowing through a signal cable and decreasing irradiation from the signal cable, and thus decreasing noise from a power source or GND owing to simultaneous switching.

By dividing data groups into red (R), green (G), and blue (B) during the digital signal delaying process, the number of signals for switching of data can be evenly distributed, switching timings of data can be distributed and simultaneous switching can be decreased. In view of a bus wiring of combined pixels (OR) (ER) (OG) (EG) (OB) (EB) on the board during the digital signal delaying process (wherein R, G, and B denote red, green and blue, respectively, E an even-numbered pixel, and 0 an odd-numbered pixel), simultaneous switching on the same board can be decreased by setting phase differences between even-numbered pixel data components and odd-numbered pixel data components.

By employing the phase changing function for digital signals, clock output phases are changed in order to secure set up time and hold time of digital signals which may not be secured depending on the filter.

BRIEF DESCRIPTION OF THE DRAWINGS

A more complete appreciation of the invention and many of the attendant advantages thereof will be readily obtained as the same becomes better understood by reference to the following detailed descriptions when considered in connection with the accompanying drawings, wherein.

DESCRIPTION OF THE PREFERRED EMBODIMENTS

Figure 1:
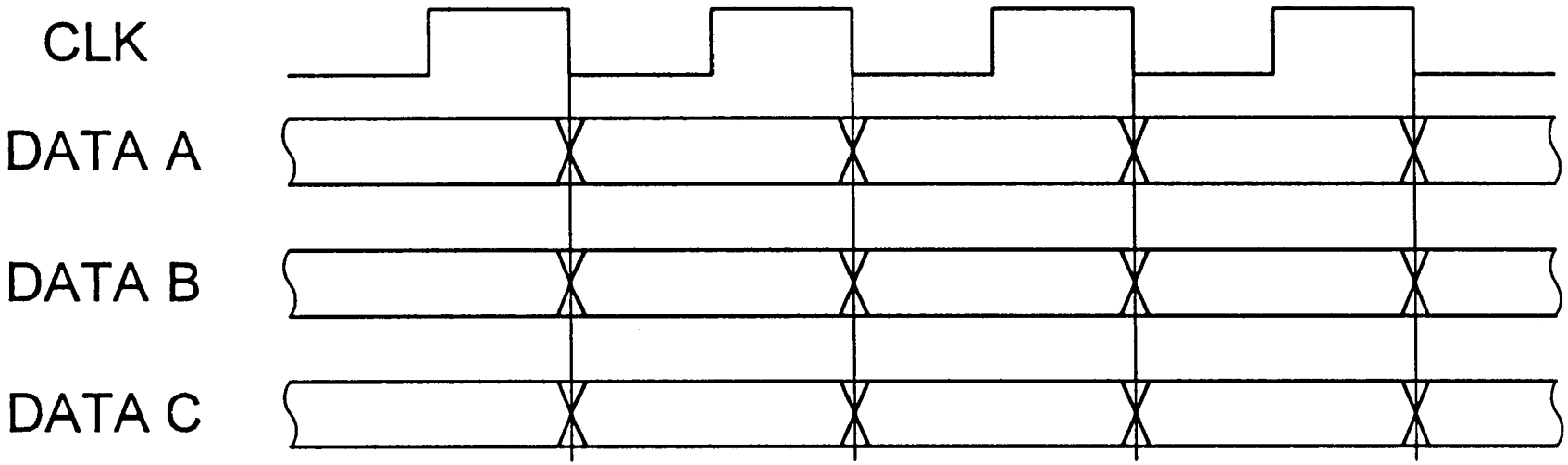
FIG. 1 is an explanatory view illustrating a waveform output timing relating to one embodiment of the present invention.

Referring now to the drawings, wherein like reference numerals designate identical or corresponding parts throughout the several views, and more particularly to FIGS. 1–13 thereof, there is illustrated an exemplary embodiment of the present invention.

Embodiment 1

It will now be explained an example of a control circuit for controlling a driving circuit that supplies signals to a displaying means such as a liquid crystal display wherein display is performed by processing digital data at high speed. The control circuit according to Embodiment 1 of the present invention changes data timings of data signals by inserting delay elements as selective elements. By assigning phase differences in current flowing through signal cables and distributing by shifting switching timings related to each data signal, irradiation from the signal cables is decreased. This also serves to decrease irradiation from a power source/GND by simultaneously switching of the IC. A selective element is an element which serves to delay timings of signals, an example of which is a delay element, and a plurality of buffers coupled together or a plurality of inverters coupled together may alternatively be used. The control circuit according to this embodiment of the present invention is comprised of a clock delaying circuit including a delay element 1 and multiplexer 4, and a latch or flip-flop, as shown in FIG. 4.

Figure 2:
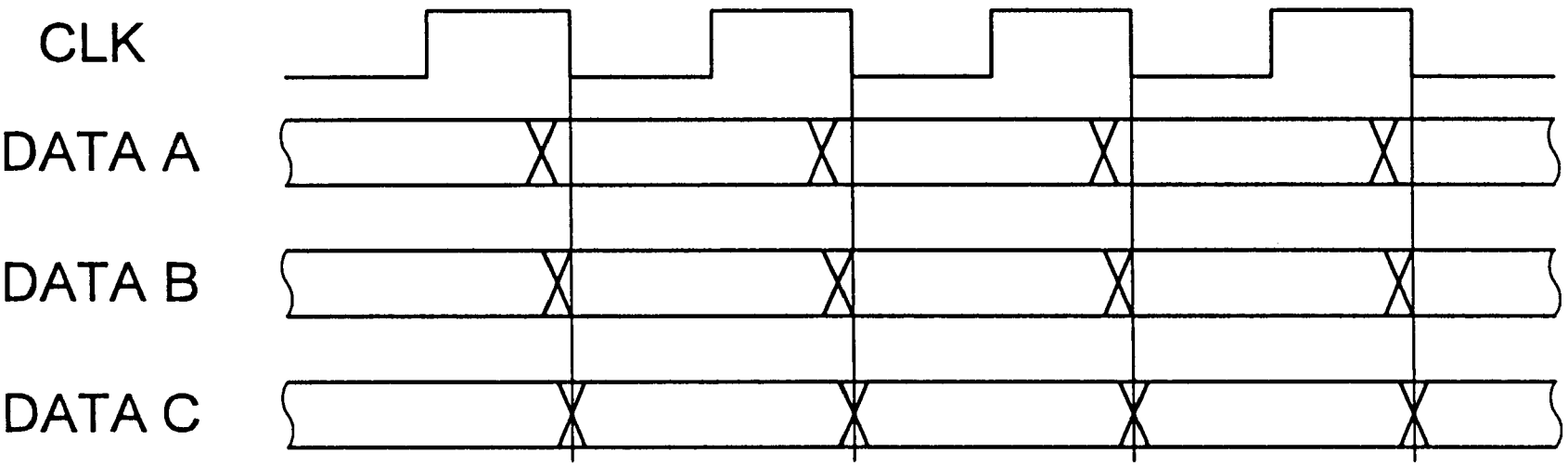
FIG. 2 is an explanatory view illustrating a waveform output timing relating to one embodiment of the present invention.
Figure 3:
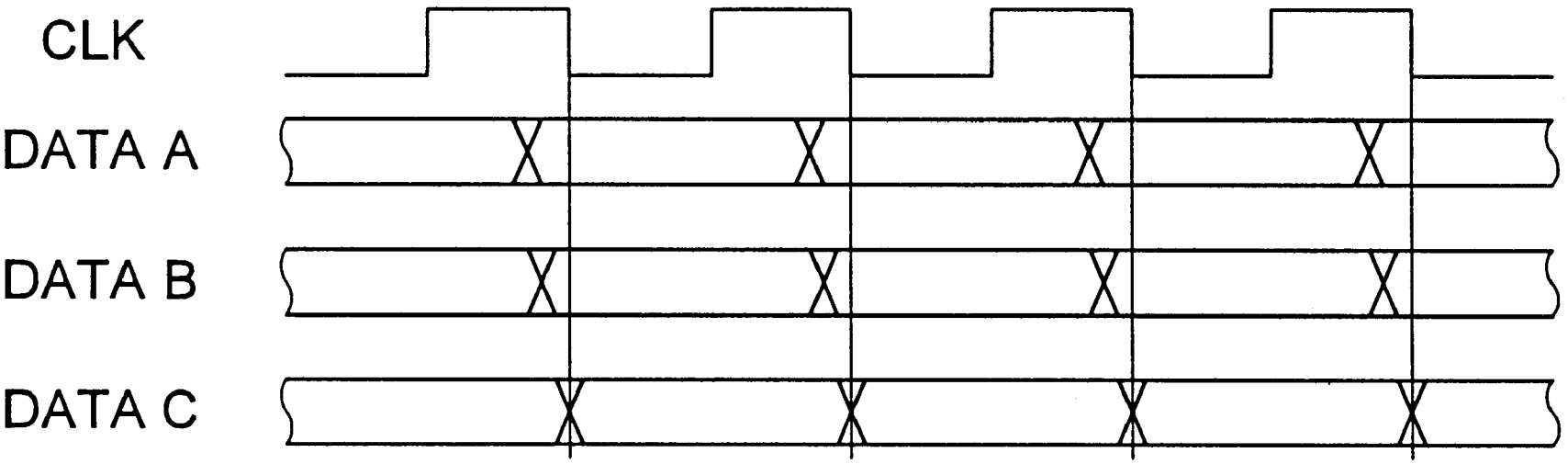
FIG. 3 is an explanatory view illustrating a waveform output timing relating to one embodiment of the present invention.
Figure 4:
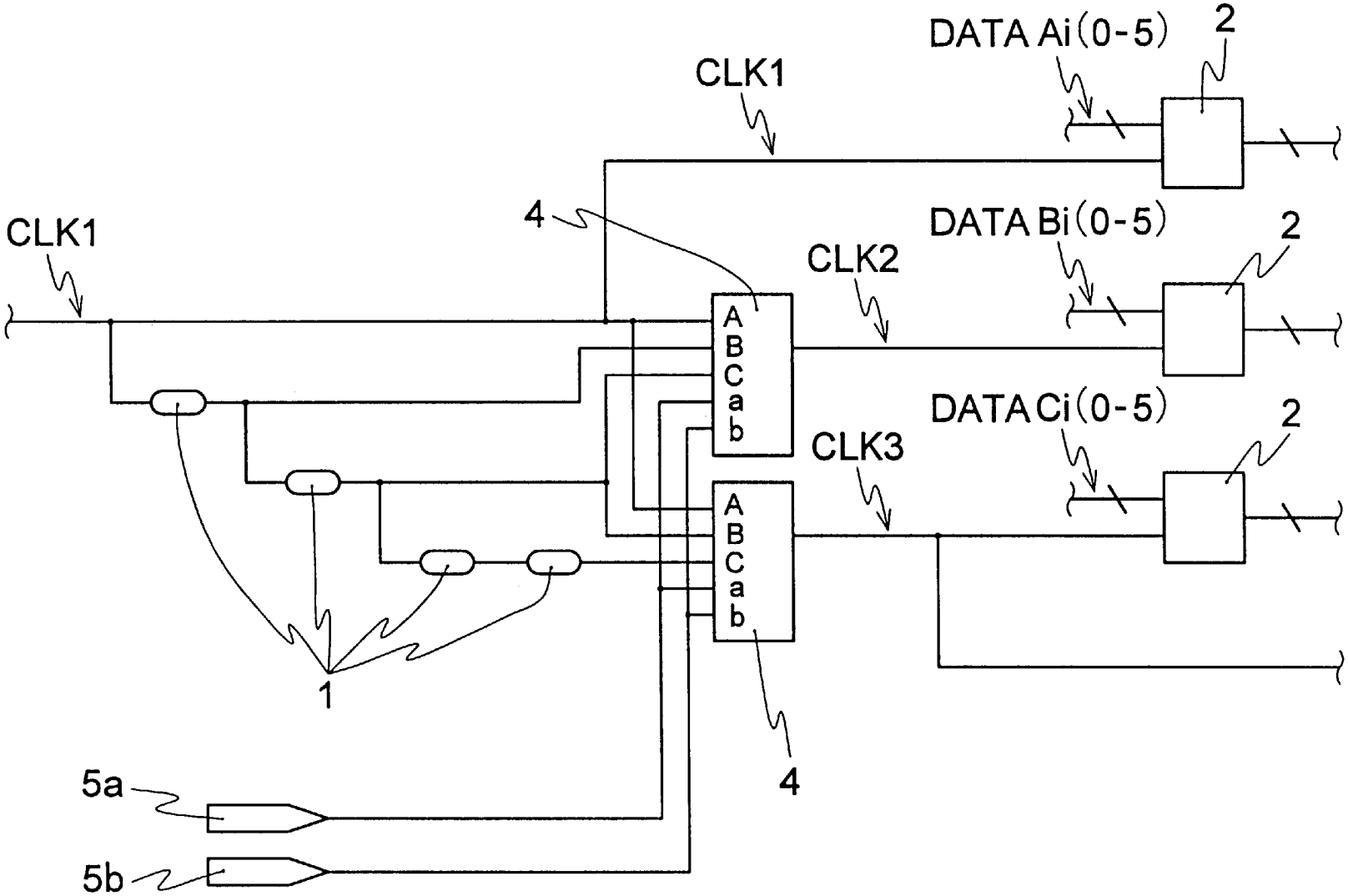
FIG. 4 is a circuit diagram of data timing delay reference to obtain signals of the present invention shown in FIG. 1.

FIG. 1, FIG. 2 and FIG. 3 are each explanatory view showing timings of data and clock, and FIG. 4 is an explanatory view showing an example of a particular circuit for performing output at the timing as shown in FIG. 1. FIG. 1, FIG. 2 and FIG. 3 may alternatively be changed as to show no phase difference in FIG. 1, small phase difference in FIG. 2 and large phase difference in FIG. 3, depending on the setting. In FIG. 4, numeral 1 denotes a delay element, numeral 2 a latch, numerals 4 a multiplexer, numerals 5*a* and 5*b* data setting terminals, reference characters CLK1 to CLK3 clock lines, respectively, and reference character DATA A*i* (0–5), DATA B*i* (0–5), and DATA C*i* (0–5) data lines, respectively, wherein the right-hand side in the drawings is an output side. These reference symbols are commonly used also in the drawings following FIG. 5. For convenience's sake, it is assumed that no delay occurs in signal waveforms except those caused by the delay elements.

As shown in FIG. 4, clocks delayed at several types of timing are produced by the delay elements, and data timings are changed by latching the data by the delayed clocks. At this time, a plurality of digital signals are outputted at different phases, and phase differences are provided at equal intervals and at several stages. Provided that the example circuit of FIG. 4 can provide for phase differences of 2 ns by the delay elements, data signals can be outputted by the circuit of FIG. 4 at different phases and phase differences of three stages and at intervals of 2 ns or 4 ns can be provided.

Figure 5:
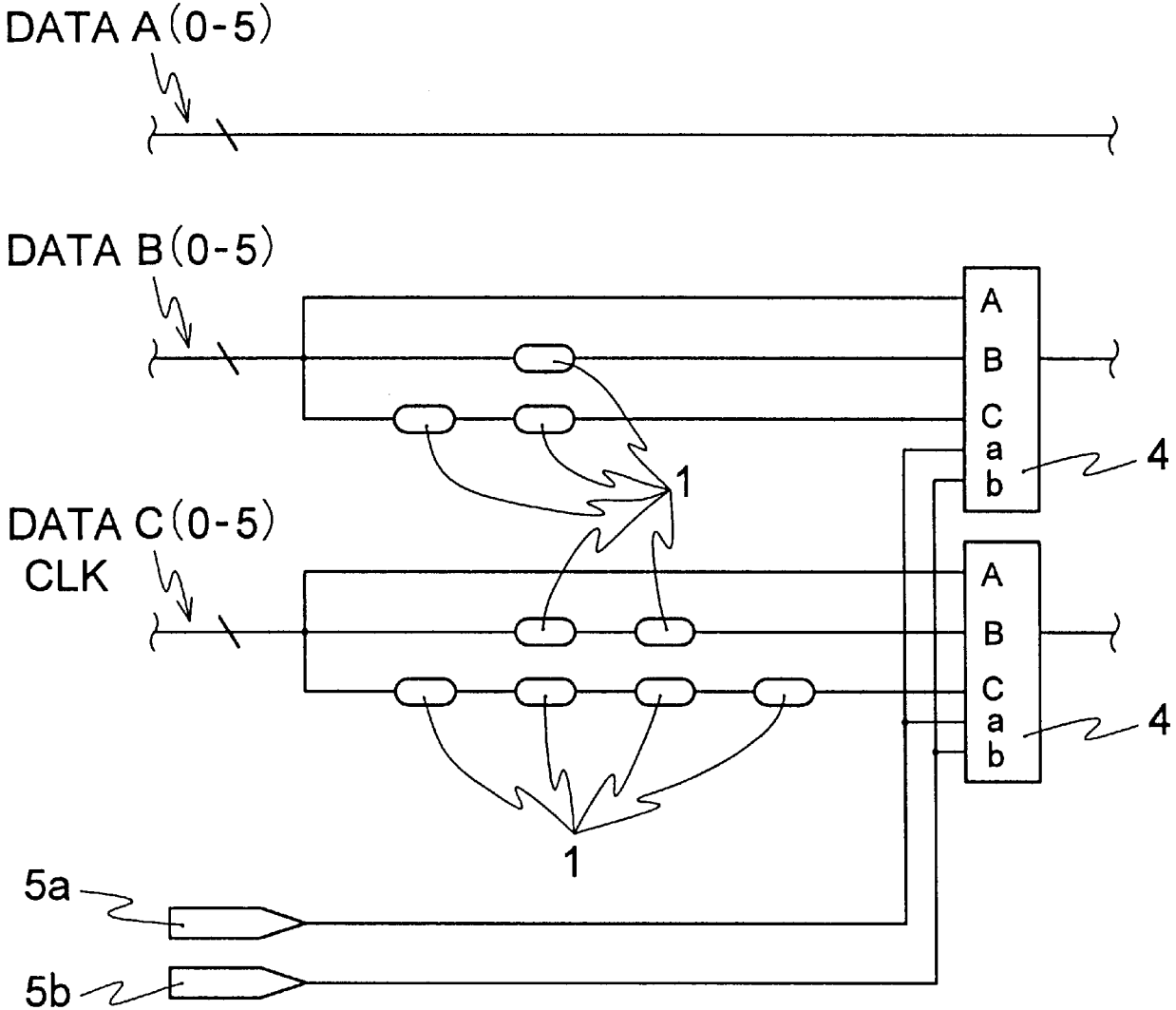
FIG. 5 is a conventional circuit diagram of data timing delay reference to obtain signals of shown in FIG. 1.

As shown in FIG. 4, a considerable number of delay elements can be decreased than compared to cases in which delay elements were made to pass through data signal cable. FIG. 5 is an explanatory view showing a conventional data timing delay reference circuit for obtaining signals as shown in FIG. 1, FIG. 2, and FIG. 3. In case the conventional circuit as shown in FIG. 5 is employed, fifty four delay elements are required when the number of data is eighteen. However, when employing the example circuit of the present invention, only four delay elements are required. Moreover, since conventional gates are employed for the latch elements, it does not result in increases/decreases in the number of gates.

The multiplexer as shown in FIG. 4 is arranged to output a signal which is input to A when (a,b)=(0,0) is satisfied, a signal which is input to B when (a,b)=(1,0) is satisfied, and a signal which is input to C when (a,b)=(0,1) is satisfied, respectively. The signal which is inputted to the multiplexer can be set from outside the control circuit, whereby it is enabled to set a phase difference of a most suitable condition for irradiated noise. By selecting a clock which synchronizing phases have been changed by the multiplexer in this manner, setting of phase differences has been enabled. By this arrangement, a most suitable condition for radiated noise can be easily set in case frequencies need to be changed when functions of the control circuit itself are changed. Such a function of assigning phase differences to digital signals can be provided by the clock, delay elements, multiplexer, latch or flip-flop, and the control circuit of this embodiment is provided with this function.

Figure 6:
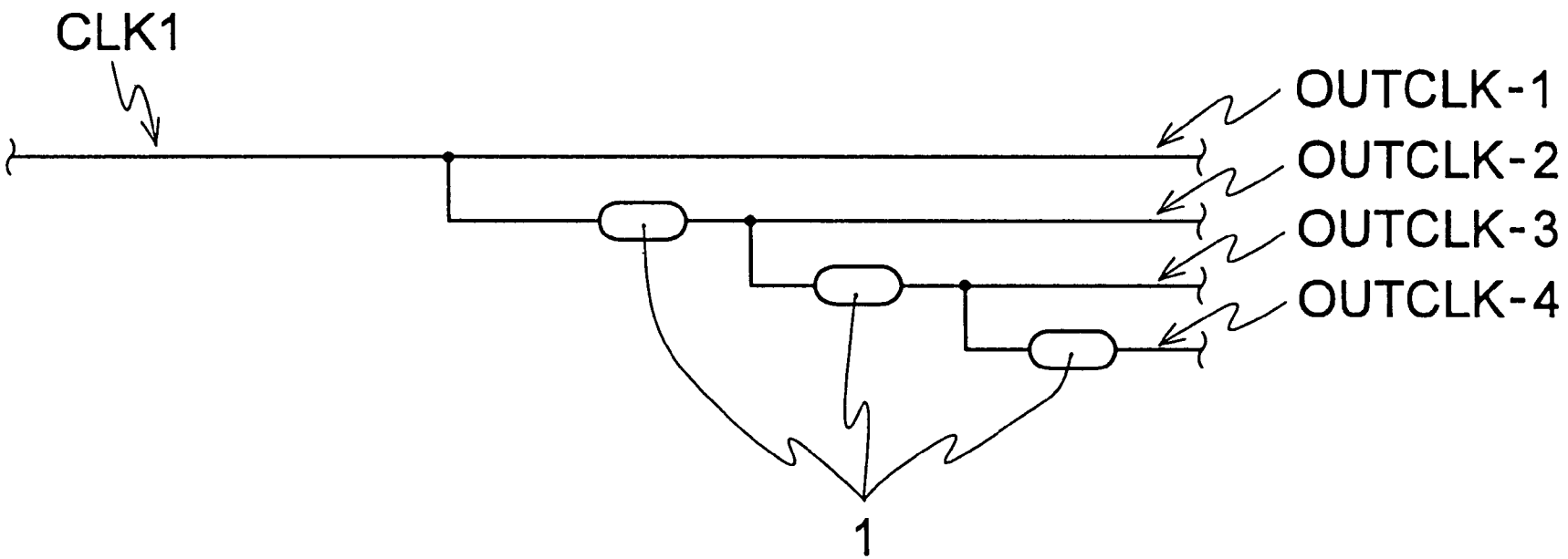
FIG. 6 is a circuit diagram of data timing delay reference to obtain signals relating to another embodiment of the present invention.
Figure 7:
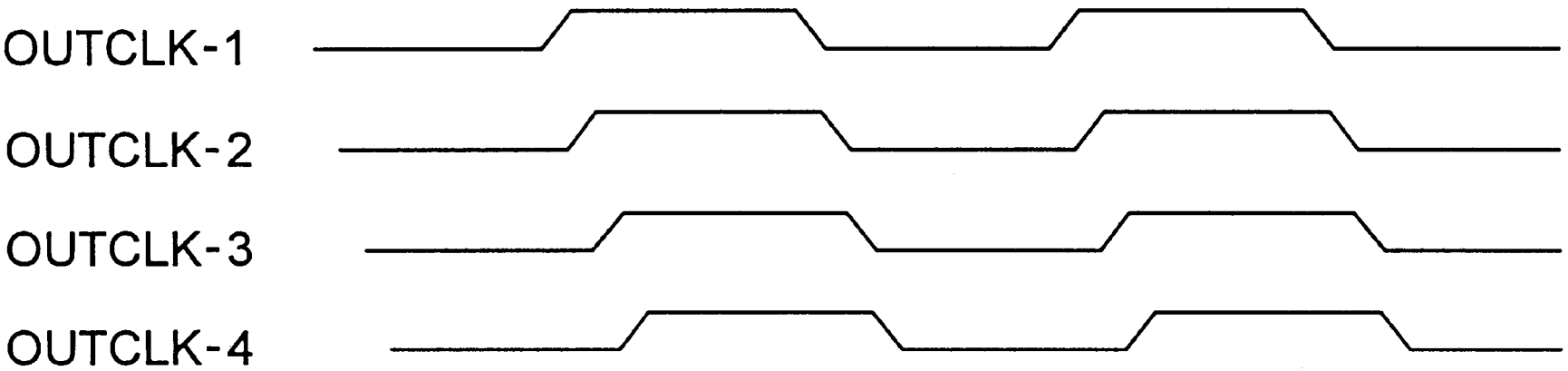
FIG. 7 is an explanatory view illustrating a delay clock waveform relating to another embodiment of the present invention.

FIG. 4 is an explanatory view showing an example of a data timing delaying reference circuit, and FIG. 6 is an explanatory view showing a clock delaying circuit. As shown in FIG. 4, digital signals can be assigned with phase differences of several stages. For instance, when there are provided three stages for the delay of clocks, each time a delay signal of one stage is generated, it can be reliably delayed to four stages by the creation of branching by the delay circuit such as delay elements as in the clock delaying circuit member of FIG. 4 or the example circuit of FIG. 6. In this way, since it is possible to perform delays at four stages, influences of variations in delay time owing to environments of utilization or gate functions can be made small. FIG. 7 is an explanatory view showing an example of a delay clock when employing the circuit of FIG. 5.

Figure 8:
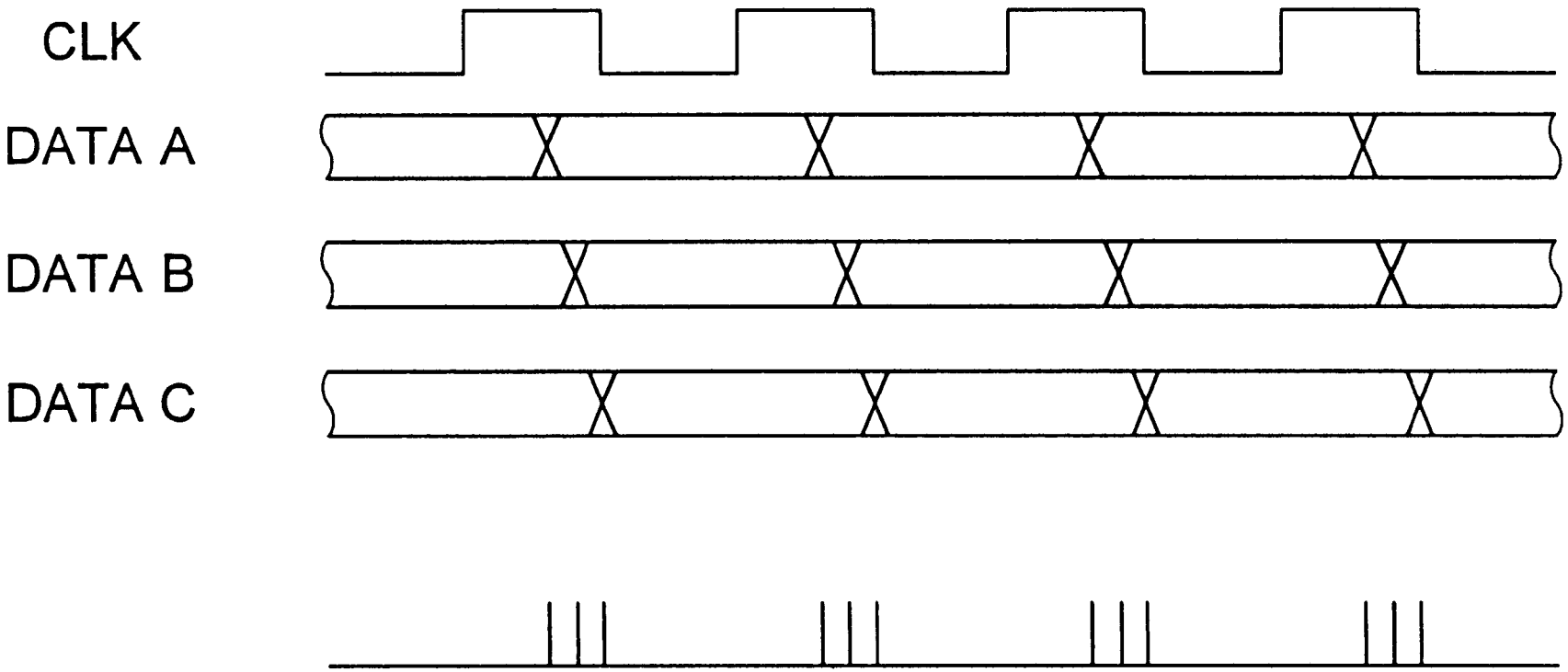
FIG. 8 is an explanatory view illustrating an input power noise waveform generated by feedthrough current relating to another embodiment of the present invention.
Figure 9:
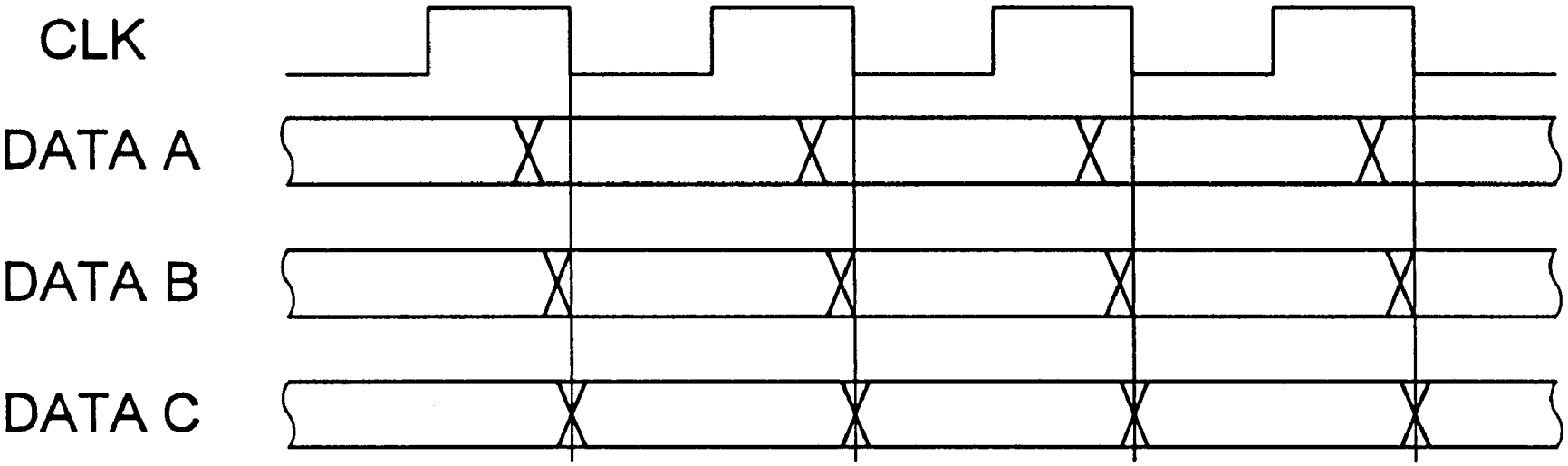
FIG. 9 is an explanatory view illustrating a wafeform output timing of the waves having different intervals relating to another embodiment of the present invention.

It may be that new frequency components may be generated by assigning phase differences at several stages to the digital signals. For instance, when a digital signal outputted by the control circuit is switched from HIGH to LOW, a feedthrough current is generated. FIG. 8 is an explanatory view showing a waveform of a feedthrough current, and when the waveform of the feedthrough current changes to a condition as shown in FIG. 8, new frequency components of noise are generated owing to the generation of electric changes having new frequency components. Such new high-frequency components can be restricted by making signals output at phase differences of different intervals. FIG. 9 is an explanatory view showing an example for providing phase differences at different intervals. By the provision of phase differences of different intervals as shown in FIG. 9, generation of new frequency components can be restricted. At this time, delay values can be changed by changing types, numbers and combinations of delay elements, buffers or inverters as shown in FIG. 4 of in FIG. 10. Alternatively, it is possible to output signals at phase differences of different intervals by short-circuiting the delay element (b) portion in case all of the delay gates as shown in FIG. 4 are identical and (a,b)=(0,1) is satisfied. Signals of different phase differences can be outputted by independently inputting setting terminals to the (a,b) of the multiplexer.

For instance, by inputting (a,b)=(1,0) to one multiplexer 4 of FIG. 4 and (a,b)=(0,1) to the other multiplexer 4, the phase of DATA B is changed by one delay element and that of DATA C by three delay elements. That is, such a function of outputting signals at phase differences of different intervals is made possible by changing selective elements of a delay means of the circuit as shown in FIG. 4, and the control circuit of this embodiment of the present invention is provided with this function.

Therefore, the phase interval between DATA A and DATA B corresponds to one delay element, and the phase interval between DATA B and DATA C corresponds to two delay elements, whereby different phase differences can be provided.

Figure 10:
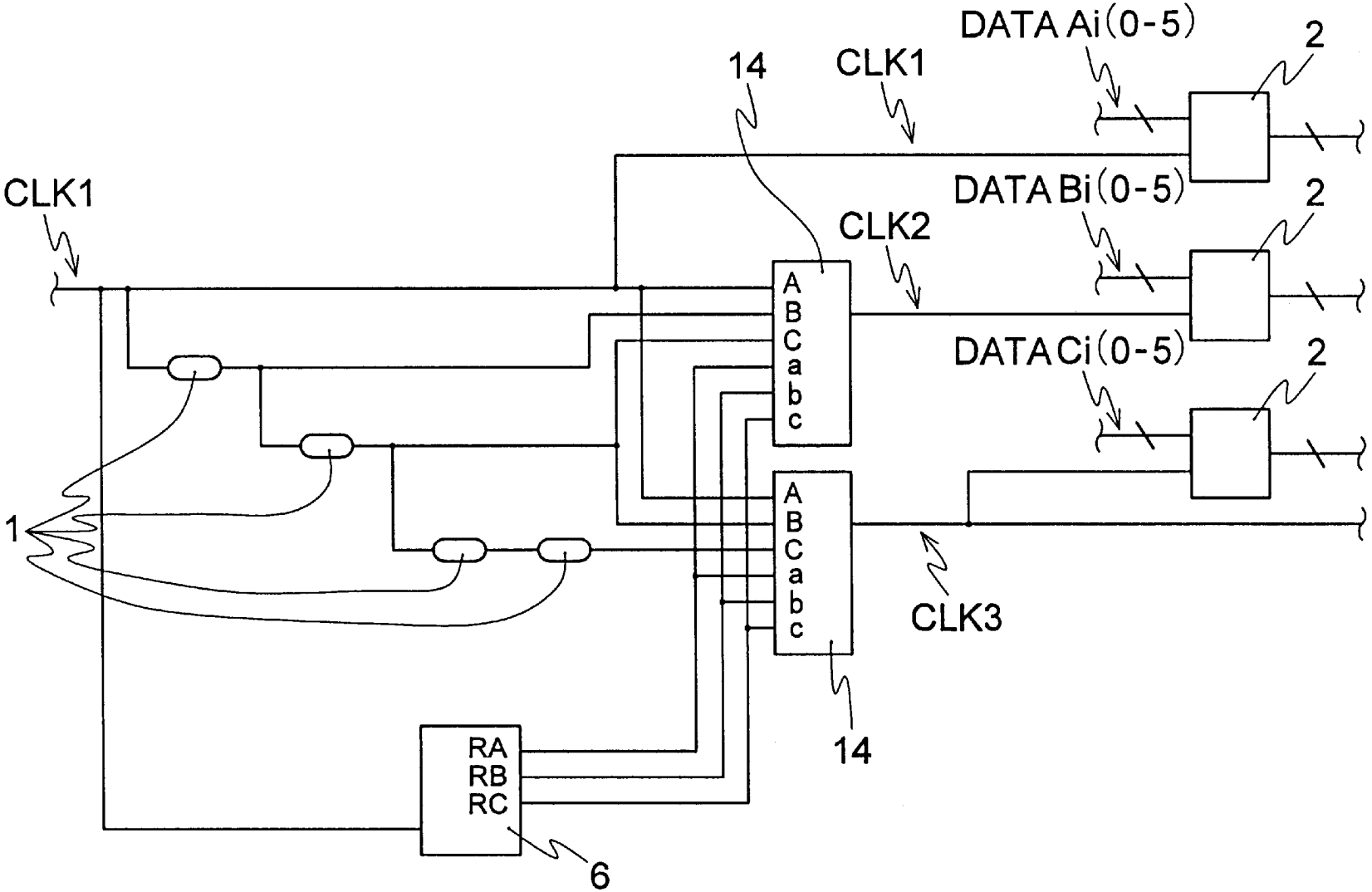
FIG. 10 is an explanatory view illustrating an example of a circuit in which phase differences of signals can be varied with respect to time relating to another embodiment of the present invention.
Figure 11:
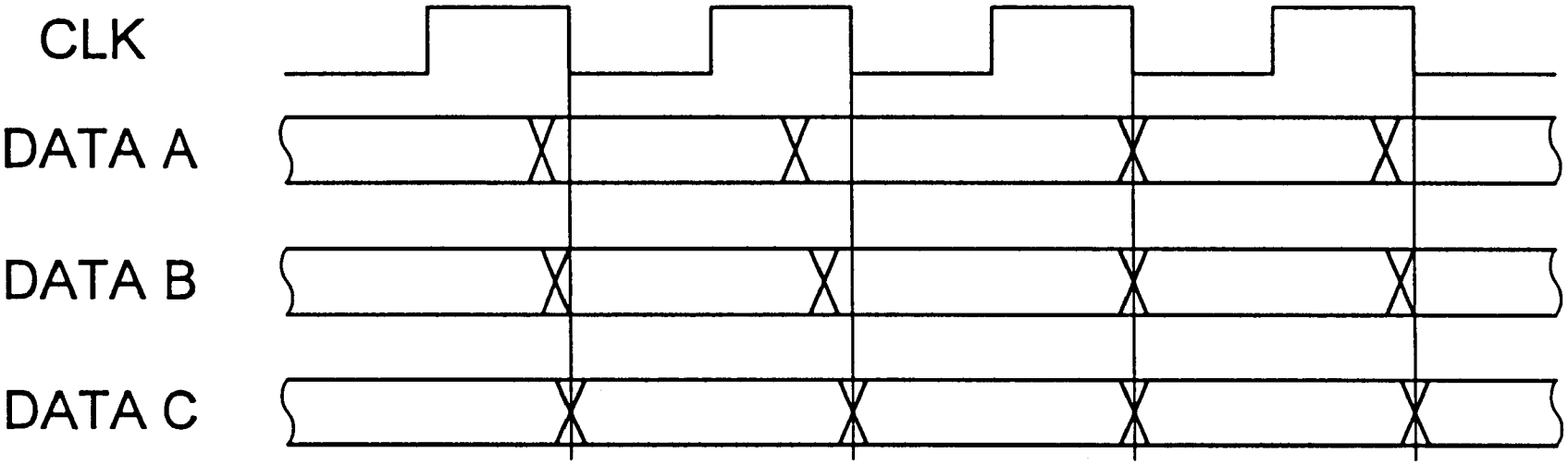
FIG. 11 is an explanatory view illustrating waveform output timing in which phase difference intervals of signal are varied with respect to time relating to another embodiment of the present invention.

FIG. 10 is an explanatory view showing a circuit for restricting generation of the new frequency components, wherein in FIG. 10, numeral 6 denotes a circulating register, 14 a multiplexer, and the remaining reference numerals are identical with those of FIG. 4. For instance, by employing a circuit as shown in FIG. 10 which enables it to assign multiple phase differences, and by changing setting signals which are taken into the multiplexer with time by a shift register, the phase difference intervals are kept on being variable. The multiplexer 2 of FIG. 10 which has been mentioned as an example outputs signals to be inputted to A, B and C, respectively, when HIGH is inputted to a, b, and c, respectively. FIG. 11 is an explanatory view showing an example of a method of randomizing variations in phase differences wherein variations in phase differences may be randomized as shown in FIG. 11 by employing a counter or random pulse generating circuit instead of the shift register of FIG. 10 and providing a circuit for inputting HIGH to the selectors a, b, and c either periodically or randomly. Such a function of changing phase differences with time is provided by a selective signal generating circuit (in this case, the circulating register) for input to the multiplexer, and the control circuit of the present invention is provided with this function. The control circuit according to this embodiment is identical with conventional ones except of the above explained points. In the following embodiment, only points that differ from this Embodiment 1 will be explained.

Embodiment 2

Figure 12:
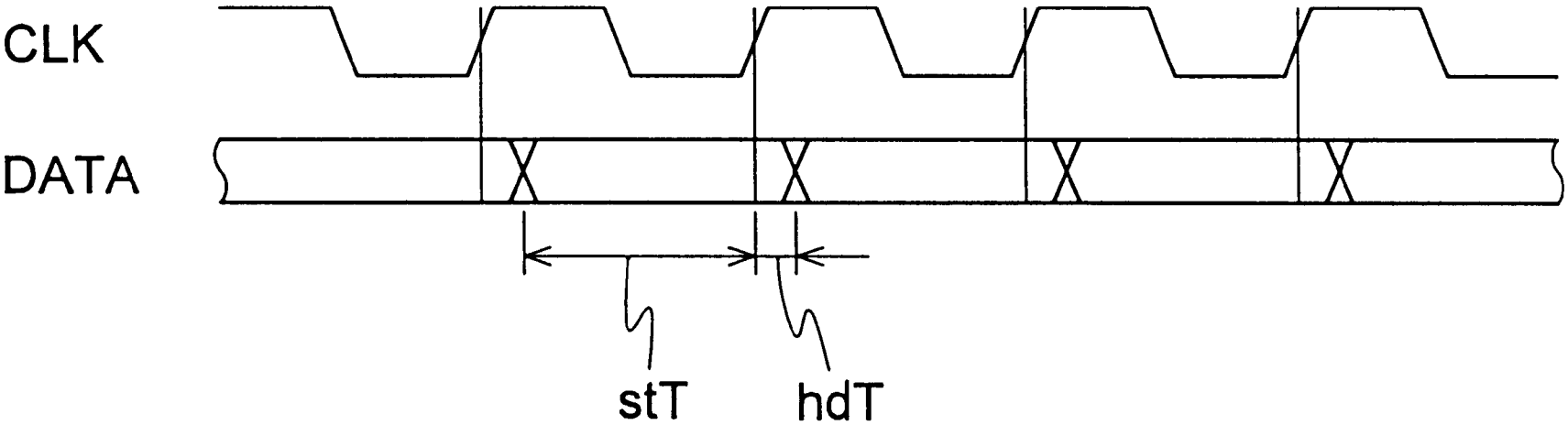
FIG. 12 is an explanatory view illustrating an example in which a margin for hold time is not allowed relating to another embodiment of the present invention.
Figure 13:
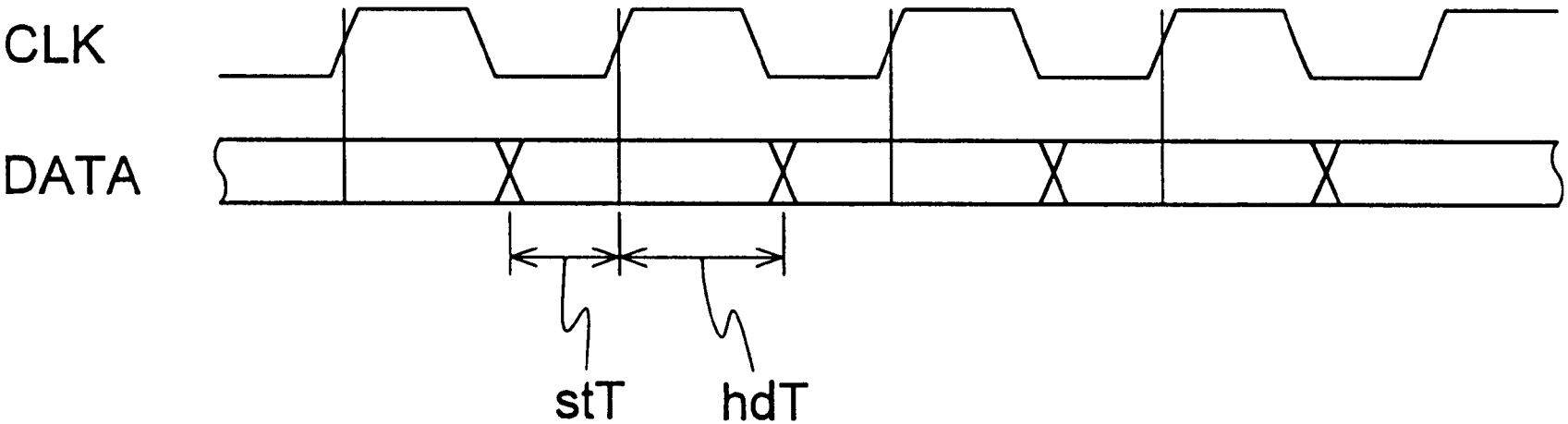
FIG. 13 is an explanatory view illustrating an example in which clock is inverted to the case shown in FIG. 12 and in which a margin for set up time and hold time is allowed.

FIG. 12 is an explanatory view showing a case in which no margin for the hold time (hdT) is provided, and FIG. 13 is an explanatory view showing a case in which margins for the set up time (stT) and hold time have been allocated by reversing the clock. In case the delay of digital data signals becomes large due to a noise filter consisting of a conductor and inductor, and the set up time and hold time can not be allocated as shown in FIG. 12, the clock can be apparently delayed or advanced by a half wavelength by reversing the clock signal as in the delay circuit or as shown in FIG. 13, and the set up time and hold time can be allocated.

In case no set up time and hold time can be allocated even by reversing the clock signal, clock signals are delayed by delay elements to secure the set up time and hold time. Also in this case, by processing data signals with respectively delayed clocks, clock signals can be assigned with phase differences of several stages.

In case delay amounts of clock signals can be determined by respective settings, margins for the set up time and hold time can be allocated by adjusting timings for the clock signals based on the prevailing set up time and hold time.

It is achieved for an effect by the control circuit of decreasing radiation from signal cables by providing phase differences to current flowing through the signal cables. It is also achieved for an effect of decreasing radiation from power source/GND by simultaneously switching the IC. Further, noise of newly generated frequency components can be restricted by the provision of phase differences also of arbitrary operating frequencies, more preferable phase differences can be determined at the stage of evaluating models/noise after designing.

It is achieved for an effect by the control circuit of distributing signal waveforms of newly generated frequency components by providing phase differences at different intervals, and of distributing bands of noise and extraneous radiation.

It is achieved for an effect by the control circuit of distributing signal waveforms of newly generated frequency components by providing phase differences at different intervals, and of distributing bands of noise and extraneous radiation.

It is achieved for an effect by the control circuit of remarkably decreasing the number of gates and of simplifying circuit arrangements.

The embodiments of the present invention may also be applied to control circuits such as plasma display devices (PDP) which handle different types of digital signals to achieve the same effects.

It should be understood that the apparatus and methods which have been shown and described herein are illustrative of the invention and are not intended to be limitative thereof. Clearly, those skilled in the art may conceive of variations or modifications to the invention. However, any such variations or modifications which falls within the purview of this description are intended to be included therein as well. The scope of the invention is limited only by the claims appended hereto.

What is claimed is:

1. A control circuit for controlling registered data signals provided to a display device, said control circuit comprising:

a plurality of series-connected digital delay elements adapted to receive a clock signal at an input of the series-connected digital delay elements; and at least one decoder device having inputs coupled to connection points of said series-connected delay elements and including at least one selection signal input, wherein a delayed version of the clock signal is output from said decoder device as a function of a signal at the selection signal input of the decoder device, and at least one of the clock signal and the delayed version of the clock signal is used to respectively clock at least one register for registering the data signals.

2. The circuit of claim 1, wherein said decoder device comprises a three input, one output, two selection signal input, decoder device.

3. The circuit of claim 1, wherein said digital delay elements comprise 2 ns digital delay elements.

4. The circuit of claim 3, wherein said at least one decoder device comprises first and second decoder devices each including first through third inputs, one output, and first and second selection signal inputs.

5. The circuit of claim 4, wherein the circuit is adapted to clock a first, second and third register for registering respective of said data signals.

6. The circuit of claim 5, wherein said plurality of series-connected digital delay elements comprise first through fourth series-connected 2 ns digital delay elements.

7. The circuit of claim 6, wherein said clock signal is adapted to clock said first register, said output of said first decoder device is adapted to clock said second register, and said output of said second decoder device is adapted to clock said third register.

8. The circuit of claim 7, wherein said first selection signal inputs of said first and second decoder devices are connected, and said second selection signal inputs of said first and second decoder devices are connected.

9. The circuit of claim 8, wherein said first inputs of said first and second decoder devices are connected and adapted to receive said clock signal.

10. The circuit of claim 9, wherein said first digital delay element is disposed between said clock signal and said second input of said first decoder device.

11. The circuit of claim 10, wherein said first and second digital delay elements are disposed between said clock signal and said third input of said first decoder device, and said first and second digital delay elements are disposed between said clock signal and said second input of said second decoder device.

12. The circuit of claim 11, wherein said first through fourth digital delay elements are disposed between said clock signal and said third input of said second decoder device.

13. The circuit of claim 12, further comprising a register provided between said first and second selection signal inputs of said first and second decoder devices and said clock signal.

14. A control circuit for controlling the timing sequence of outputting registered data to a display device, comprising:

a plurality of series-connected delay elements adapted to receive a clock signal at an input thereof and configured to provide several stages of delayed versions of the clock signal; and a plurality of latches for outputting registered data at a timing sequence selected based on a combination of the clock signal and a delayed version of the clock signal from the series-connected delay elements;

wherein a sum of a total delay time of the series-connected delay elements is less than one cycle of the clock signal.

15. The control circuit of claim 14, wherein a delay time of each delay element is on an order of nanoseconds.

* * * * *